United States Patent [19]

Wilson et al.

[11] Patent Number: 5,021,135

[45] Date of Patent: Jun. 4, 1991

[54] METHOD FOR TREATMENT OF ELECTRODEPOSITION BATH

[75] Inventors: Craig A. Wilson, Bakerstown; Kurt G. Olson, Gibsonia; Jeffrey G. Koren, Saxonburg; Debra M. Longhini, Pittsburgh; Carol S. Dugan, New Kensington; Edward L. Jozwiak, Jr., Allison Park, all of Pa.

[73] Assignee: PPG Industries, Inc., Pittsburgh, Pa.

[21] Appl. No.: 422,860

[22] Filed: Oct. 17, 1989

[51] Int. Cl.[5] ..... G25D 13/22; G25D 13/10

[52] U.S. Cl. ..... 204/180.8; 204/181.4; 204/181.7

[58] Field of Search ..... 204/180.8, 181.4, 181.7

[56] References Cited

U.S. PATENT DOCUMENTS

| | | | |
|---|---|---|---|
| 3,663,397 | 5/1972 | Le Bras et al. | 204/181 |
| 3,663,398 | 5/1972 | Christenson et al. | 204/181 |
| 3,663,403 | 5/1972 | Christenson et al. | 204/181 |
| 3,935,087 | 1/1976 | Jerabek | 204/181.7 |
| 4,012,351 | 3/1977 | Hall et al. | 260/29.6 R |
| 4,395,528 | 7/1983 | Leiner | 204/181.7 |
| 4,495,327 | 1/1985 | Schenck | 204/181.7 |

FOREIGN PATENT DOCUMENTS 63-251484 10/1988 Japan .

OTHER PUBLICATIONS

Analytical Chemistry by J. G. Dick, pp. 161–169.

"Photostabilization by Hindered Amines: The Role of Transition Metal Complexation", by Fairgrieve et al., Polymer Communications, 1984, vol. 25, Feb., pp. 44–46.

*Primary Examiner*—John F. Niebling
*Assistant Examiner*—Kishor Mayekar
*Attorney, Agent, or Firm*—Daniel J. Long

[57] ABSTRACT

In a method for electrocoating an electrically conductive surface serving as an electrode, which method comprises passing an electrical current between the electrically conductive surface to be electrocoated and a counter electrode in contact with an electrodeposition bath comprising a synthetic resin ionically dispersed in an aqueous medium, wherein improvement comprises (a) adding a complexing agent, and then (b) removing at least a portion of the complexing agent along with metals coordinated therewith from the bath.

25 Claims, 1 Drawing Sheet

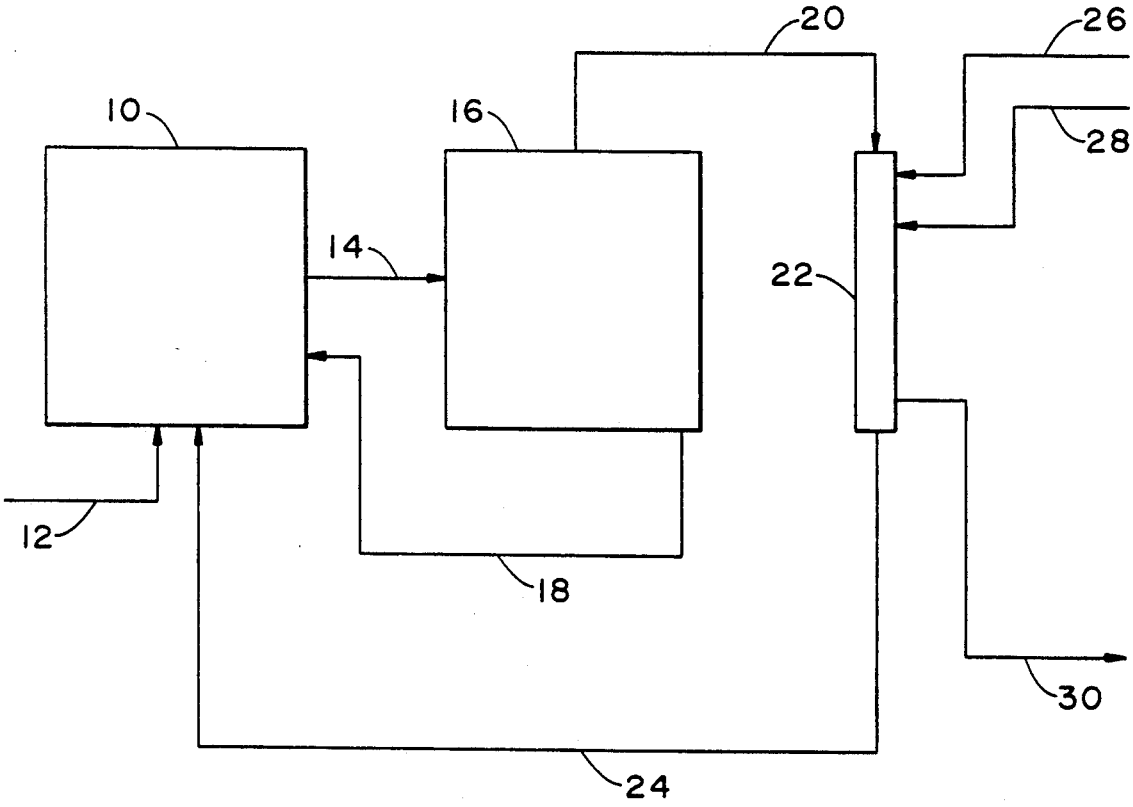
20
26
10
16
28
14
22
12
18
30
24

METHOD FOR TREATMENT OF ELECTRODEPOSITION BATH

BACKGROUND OF THE INVENTION

1. Field of the Invention

The present invention relates to the application of coatings by electrodeposition and more particularly to the treatment of the electrodeposition bath to maintain initial bath properties.

2. Brief Description of the Prior Art

Electrodeposition has become a widely commercially accepted industrial coating technique. The coatings achieved have excellent properties for many applications and electrodeposition results in a coating which does not run or wash off during baking. Virtually any conductive substrate may be coated by electrodeposition, the most commonly employed substrates being metals.

In the electrodeposition process, the articles to be electrocoated are immersed in an aqueous dispersion of solubilized, ionized, film-forming materials such as synthetic organic vehicle resins. An electric current is passed between the article to be coated, serving as an electrode, and a counter electrode to cause deposition of a coating of the vehicle resin on the article. The article is then withdrawn from the bath, usually rinsed and then the coating either air-dried or baked in the manner of a conventional finish.

A major problem in the continuous electrodeposition process has been the control of the electrodeposition bath to maintain initial bath properties. One problem is that the bath often tends to become contaminated with iron and other metals. In the case of iron, the source of this contamination can be ferrous metal electrodes used in the electrodeposition process or parts of the articles being coated which may remain in the bath.

In the case of contamination with iron and other metals such as zinc, cadmium, copper, magnesium and calcium, it is believed that such contamination may result in a tendency of the resulting coating to be degraded by ultraviolet light. It is, therefore, the object of the method of the present invention to provide a means to treat electrodeposition baths to reduce or eliminate the tendency of the finished coating to degrade under such conditions.

SUMMARY OF THE INVENTION

In the method of the present invention, a complexing agent capable of coordinating with soluble iron or other metals in the electrodeposition bath is introduced to the bath. The bath is then intermittently or continuously removed to an ultrafilter through which the complexing agent and metal complexes pass. Resins from the bath are not passed by the ultrafilter and are returned to the bath. The permeate from the ultrafilter is then treated with an ion exchange resin to remove metals after which it is returned to the bath.

BRIEF DESCRIPTION OF THE DRAWINGS

The accompanying drawing is a schematic illustration of an apparatus used to carry out a preferred embodiment of the method of the present invention.

DETAILED DESCRIPTION

Referring to the drawing, the electrodeposition bath 10 contains an aqueous electrodepositable composition comprising a synthetic resin ionically dispersed in an aqueous medium from which films are deposited using suitable apparatus (not shown). A complexing agent and preferably a chelating agent capable of complexing with iron or other metals in the bath is added in line 12. This chelating agent may be, for example, 1,10-phenanthroline, 4,7-diphenyl-1,10-phenanthroline, alpha, alpha'-dipyridyl, 2,2',2''-terpyridyl, 2-pyridinealdoxime, ethylenediamine tetraacetic acid, diethylenetriamine pentaacetic acid, methyl acetoacetate and acetylacetone. The stability constant of the chelating agent-metal ion complex should be greater than the stability constant of the resin-metal ion complex in the bath. The chelating agent is added in an amount of about 0.5 mole equivalent of chelating agent to 1 mole of soluble iron in the bath to about 7 mole equivalents of chelating agent to 1 mole of soluble iron in the bath. Soluble iron would be determined by first centrifuging a sample of the bath to remove pigments, after which insoluble material would be separated and the amount of iron in the aqueous phase would be measured.

For the purposes of this disclosure, a complexing agent will be considered to be any organic or inorganic molecule or ion that is bonded to a metal ion by a coordinate covalent bond, i.e., a bond based on a shared pair of electrons both of which come from the complexing agent. A chelating agent will be considered to be any complexing agent that coordinates a metal ion in more than one position, i.e., through two or more electron donor groups in the complexing agent. The complexation phenomenon is discussed, for example, in *Analytical Chemistry* by J. G. Dick, McGraw-Hill, New York (1973), pages 161–169, which are hereby incorporated by reference. A quantity known as the stability or formation constant, $K_i$, is a measurement of the tendency of a particular chelating agent to complex with a metal ion in a homogeneous solution. The stability constant is described in the above incorporated section in *Analytical Chemistry* by J. G. Dick. While not intending to be bound by any theory of this invention, it is believed that preferred chelating agents for use in the method of the present invention would be those which have a higher stability constant than the resin which is included in the bath.

Before the chelating agent is added, the soluble iron in the bath may also be reduced from a ferric state to a ferrous state by adding a reducing agent to the bath. A suitable reducing agent would be, for example, hydroquinone, erythorbic acid, sodium metabisulfite, sodium sulfite, sodium formaldehyde sulfoxylate, ascorbic acid, hydrogen sulfide, sulfurous acid, zinc, cadmium, aluminium and silver. The reducing agent would be used in an amount of 0.5 to 1.5 equivalents of reducing agent per equivalent of soluble iron or other metal in the bath.

A portion of the bath may be continuously or intermittently withdrawn in line 14 to an ultrafilter 16. Here in the ultrafilter process chelating agent along with complexed iron or other metal is separated from the resin, pigment and other higher molecular weight components which are present in the bath composition. The concentrate or retentate may be returned to the bath through line 18. In addition to the complexing agent and complexed iron, the ultrafiltrate also includes water, excess counter ions and other low molecular weight species. This ultrafiltrate is removed from the ultrafilter in line 20 to an ion exchange column 22 containing cation exchange resin to remove iron and other metals from the ultrafiltrate. The resultant filtrate from the ion exchange column is returned to the bath through line 24. The ion exchange column can be regenerated, for example, by passing a 20 percent by weight solution of aqueous sulfuric acid through the column. Waste is removed from the ion exchange column in line 30.

Ultrafiltration encompasses all membrane-moderated, pressure-activated separations wherein solvent or solvent and smaller molecules are separated from modest molecular weight macromolecules and colloids. The term "ultrafiltration" is generally broadly limited to describing separations involving solutes of molecular dimensions greater than about ten solvent molecular diameters and below the limit of resolution of the optical microscope that is, about 0.5 micron. In the present process, water is considered to be the solvent.

The principles of ultrafiltration and filters are discussed in a chapter entitled "Ultrafiltration" in the Spring, 1968, volume of Advances in Separations and Purifications, E. S. Perry, Editor, John Wiley & Sons, New York, as well as in Chemical Engineering Progress, Vol. 64, December, 1968, pages 31 through 43, which are hereby incorporated by reference.

The basic ultrafiltration process is relatively simple. Solution to be ultrafiltered is confined under pressure, utilizing, for example, either a compressed gas or liquid pump in a cell, in contact with an appropriate filtration membrane supported on a porous support. Any membrane or filter having chemical integrity to the system being separated and having the desired separation characteristic may be employed. Preferably, the contents of the cell should be subjected to at least moderate agitation to avoid accumulation of the retained solute on the membrane surface with the attendant binding of the membrane. Ultrafiltrate is continually produced and collected until the retained solute concentration in the cell solution reaches the desired level, or the desired amount of solvent plus dissolved low molecular weight solute is removed. A suitable apparatus for conducting ultrafiltration is described in U.S. Pat. No. 3,495,465 which is hereby incorporated by reference. Further information concerning the ultrafiltration process is disclosed, for example, in U.S. Pat. Nos. 3,663,398 and 3,663,403, the contents of which are incorporated herein by reference.

The electrodeposition bath used in the method of the present invention may contain any of several electrodepositable compositions well known in the art. Electrodepositable compositions, while referred to as "solubilized", in fact are considered a complex solution, dispersion or suspension or combination of one or more of these classes in water which acts as an electrolyte under the influence of an electric current. While, no doubt, in some circumstances the vehicle resin is in solution, it is clear that in most instances the vehicle resin is a dispersion which may be called a molecular dispersion of molecular size between a colloidal suspension and a true solution.

The typical industrial electrodepositable composition also contains pigments, crosslinking resins and other adjuvants which are frequently combined with the vehicle resin in a chemical and a physical relationship. For example, the pigments are usually ground in a resin medium and are thus "wetted" with the vehicle resin. As can be readily appreciated then, an electrodepositable composition is complex in terms of the freedom or availability with respect to removal of a component or in terms of the apparent molecular size of a given vehicle component.

Examples of film-forming resins which can be used as the electrodepositable composition include the reaction products of epoxide group-containing resins and primary and secondary amines such as those described in U.S. Pat. Nos. 3,663,389; 3,984,299; 3,947,338 and 3,947,339. Usually, the epoxide group-containing resin has a 1,2-epoxy equivalency greater than 1 and preferably is a polyglycidyl ether of a polyhydric phenol such as 4,4'-bis(hydroxyphenyl)propane. Other examples include polyglycidyl ethers of phenol-formaldehyde condensates of the novolak type and copolymers of glycidyl acrylate or methacrylate.

Usually these resins are used in combination with blocked polyisocyanate curing agents. The polyisocyanate can be fully blocked as described in the aforementioned U.S. Pat. No. 3,984,299, or the isocyanate can be partially blocked and reacted with the resin backbone such as described in the aforementioned U.S. Pat. No. 3,947,338. Besides blocked polyisocyanate curing agents, transesterification curing agents such as described in European Application No. 12,463 can be used. Also, cationic electrodeposition compositions prepared from Mannich bases such as described in U.S. Pat. No. 4,134,932 can be used. One-component compositions as described in U.S. Pat. No. 4,134,866 and DE-OS No. 2,707,405 can also be used as the film-forming resin.

Besides the epoxy-amine reaction products, film-forming resins can be selected from amino group-containing acrylic copolymers such as those described in U.S. Pat. Nos. 3,455,806 and 3,928,156. In general, any polymerizable monomeric compound containing at least one $CH_2{=}C<$ group, preferably in the terminal position, may be polymerized with the unsaturated glycidyl compounds. Examples of such monomers include monoolefinic and diolefinic hydrocarbons such as styrene, halogenated monoolefinic and diolefinic hydrocarbons such as alpha-chlorostyrene, vinyl chloride, esters of unsaturated organic acids such as butyl acrylate or methyl methacrylate and vinyl esters such as vinyl acetate and unsaturated organic nitriles such as acrylonitrile. In carrying out the polymerization reaction a peroxygen type catalyst such as benzoyl peroxide can be used or an azo compound such as VAZO 67, which is 2,2'-dimethylazobis(isobutyronitrile) and is available from E. I. duPont de Nemours & Co., Inc.

The preferred resins are those which contain primary and/or secondary amino groups. Such resins are described in U.S. Pat. Nos. 3,663,389; 3,947,339 and 4,116,900. In U.S. Pat. No. 3,947,339, a polyketimine derivative of a polyamine such as diethylenetriamine or triethylenetetraamine is reacted with an epoxide group-containing resin. When the reaction product is neutralized with acid and dispersed in water, free primary amine groups are generated. Also, equivalent products are formed when polyepoxide is reacted with excess polyamines such as diethylenetriamine and triethylenetetraamine and the excess polyamine vacuum stripped from the reaction mixture. Such products are described in U.S. Pat. Nos. 3,663,389 and 4,116,900.

The aqueous cationic compositions of the present invention are in the form of an aqueous dispersion. The term "dispersion" is considered to be a two-phase transparent, translucent or opaque resinous system in which the resin is in the dispersed phase and the water is in the continuous phase. The average particle size of the resinous phase is generally less than 10 and usually less than 5 microns, preferably less than 0.5 micron.

The concentration of the resinous phase in the aqueous medium is usually at least 1 and usually from about 2 to 60 percent by weight based on weight of the aqueous dispersion. When the compositions of the present invention are in the form of resin concentrates, they generally have a resin solids content of about 20 to 60 percent by weight based on weight of the aqueous dispersion. When the compositions of the present invention are in the form of electrodeposition baths, the resin solids content of the electrodeposition bath is usually within the range of about 5 to 25 percent by weight based on total weight of the aqueous dispersion.

Besides water, the aqueous medium may contain a coalescing solvent. Useful coalescing solvents include hydrocarbons, alcohols, esters, ethers and ketones. The preferred coalescing solvents include alcohols, polyols and ketones. Specific coalescing solvents include isopropanol, butanol, 2-ethylhexanol, isophorone, 4-methoxy-pentanone, ethylene and propylene glycol and the monoethyl, monobutyl and monohexyl ethers of ethylene glycol. The amount of coalescing solvent is generally between about 0.01 and 25 percent and when used, preferably from about 0.05 to about 5 percent by weight based on weight of the aqueous medium.

In some instances, a pigment composition and if desired various additives such as surfactants, wetting agents, catalysts, film build additives and additives to enhance flow and appearance of the coating such as described in U.S. Pat. No. 4,423,166 are included in the dispersion. Pigment composition may be of the conventional types comprising, for example, iron oxides, lead oxides, strontium chromate, carbon black, coal dust, titanium dioxide, talc, barium sulfate, as well as color pigments such as cadmium yellow, cadmium red, chromium yellow and the like. The pigment content of the dispersion is usually expressed as a pigment-to-resin ratio. In the practice of the present invention, the pigment-to-resin ratio is usually within the range of 0.02 to 1:1. The other additives mentioned above are usually in the dispersion in amounts of about 0.01 to 20 percent by weight based on weight of resin solids.

When the aqueous dispersions as described above are employed for use in electrodeposition, the aqueous dispersion is placed in contact with an electrically conductive anode and an electrically conductive cathode with the surface to be coated being the cathode. Following contact with the aqueous dispersion, an adherent film of the coating composition is deposited on the cathode when a sufficient voltage is impressed between the electrodes. The conditions under which electrodeposition is carried out are, in general, similar to those used in electrodeposition of other types of coatings. The applied voltage may be varied and can be, for example, as low as 1 volt or as high as several thousand volts, but typically between 50 and 500 volts. The current density is usually between 0.5 ampere and 5 amperes per square foot and tends to decrease during electrodeposition indicating the formation of an insulating film. The coating compositions of the present invention can be applied to a variety of electroconductive substrates especially metals such as steel, aluminum, copper, magnesium and conductive carbon coated materials.

After the coating has been applied by electrodeposition, it is cured usually by baking at elevated temperatures such as 90°-260° C. for about 1 to 40 minutes.

The method of the present invention is further described in the following examples.

EXAMPLE A

An imine of diethylenetriamine and salicylaldehyde was prepared in the following manner. 122 grams (g) salicylaldehyde (1.0 mole) were added to 51.5 g diethylenetriamine (0.5 mole) and 400 g methanol. The solution was held at reflux until no carbonyl stretch was evident by IR analysis. The methanol was then stripped off and 152 g crude product were recovered. The amine equivalent weight of the product was determined to be 117 (theory 104).

EXAMPLE 1

A tank sample of POWERCRON 730[1] which had been contaminated with iron was centrifuged to remove the pigments. After decanting off the insoluble material, the amount of iron in the aqueous phase was determined by atomic absorption to be 75 parts per million (ppm). 3800 g of the acrylic paint (5.1 meq Fe) was placed in a gallon container. 7.5 g ACTIVE-8[2] and 0.6 g hydroquinone (6.0 meq) were then added to the paint. After stirring for 65 hours, the paint was ultrafiltered at a rate of 25-30 milliliters (ml)/minute through a thin channel membrane (Abcor HFM 63). The reddish-orange permeate was then passed through an ion exchange column which had previously been prepared as follows: 250 g AMBERLITE IRC-718[3] were poured into a 500 ml column filled with deionized water. A 10 weight percent solution of sulfuric acid was added to the ion exchange resin until the pH of the solution coming out of the column was <2. This was followed by adding enough deionized water to raise the pH of the exiting solution to 6-7.

[1]POWERCRON 730 is an acrylic paint available from PPG Industries, Inc.

[2]ACTIVE-8 contains 38 percent 1,10-phenanthroline, 10 percent ethylhexanoic acid and 52 percent n-butanol and is available from R. T. Vanderbilt Co.

[3]AMBERLITE IRC-718 is a cation exchange resin available from Rohm and Haas Company.

After passing through the ion exchange column the permeate was colorless. The treated permeate was then pumped back into the paint bath. After 3800 g permeate (100 percent ultrafiltration) had passed through the ion exchange column, a paint sample showed that the iron level had been reduced to 40 ppm.

EXAMPLE 2

The procedure as described in Example 1 was followed except that no ACTIVE-8 or hydroquinone were added to the paint. After 100 percent ultrafiltration, analysis showed that no iron had been removed from the paint.

EXAMPLE 3

The procedure as described in Example 1 was followed except that 2.4 g bipyridine were added in place of ACTIVE-8. After 100 percent ultrafiltration, analysis showed that 39 percent of the iron had been removed from the paint.

EXAMPLE 4

The procedure as described in Example 1 was followed except that 1.9 g 2-pyridinealdoxime were added to the paint instead of ACTIVE-8. After 100 percent ultrafiltration, analysis showed 11 percent of the iron had been removed from the paint.

EXAMPLE 5

The procedure as described in Example 1 was followed except that 5.9 g diethylenetriamine pentaacetic acid was used instead of ACTIVE-8. After 100 percent ultrafiltration, analysis showed 5 percent of the iron had been removed from the paint.

EXAMPLE 6

The procedure as described in Example 1 was followed except that to 1000 g of POWERCRON 730 acrylic paint at 67 ppm iron, 21.8 g of 3 percent by weight aqueous solution of 1,10-phenanthroline was added to the paint. 125 g of AMBERLITE IRC-84[4] in the acid form was used to remove the complexed iron from the permeate. Analysis showed 28 percent of the iron was removed from the paint.

[4]AMBERLITE IRC-84 is a cation exchange resin available from Rohm and Haas Company.

EXAMPLE 7

A test similar to Example 6 was conducted except both hydroquinone (0.12 g) and 1,10-phenanthroline (21.8 g of 3 percent by weight aqueous solution) were used. Analysis showed 37 percent iron removal.

EXAMPLE 8

The procedure as described in Example 1 was followed except that 4.7 g of the imine of diethylenetriamine and salicylaldehyde prepared in Example A was added instead of the ACTIVE-8. After 100 percent ultrafiltration, analysis showed 3 percent of the iron had been removed from the paint.

EXAMPLE 9

A 1200 g tank sample of POWERCRON 500[5] which had been contaminated with iron at 65 ppm was treated with 2.1 meq hydroquinone and 6.3 meq of 1,10-phenanthroline as ACTIVE-8. The paint was ultrafiltered and the permeate was passed through an AMBERLITE IRC-84 ion exchange resin in the hydrogen form. After 100 percent ultrafiltration and recycle of the ion exchanged permeate, the iron concentration in the bath was reduced by 33 percent.

[5]POWERCRON 500 is an epoxy paint available from PPG Industries, Inc.

EXAMPLE 10

A tank sample which had 65 ppm soluble iron was treated first with hydroquinone at a 1:1 molar ratio to convert iron +3 to iron +2. A solution of 3 percent by weight aqueous solution of 1,10-phenanthroline was added in a molar ratio of 3:1 and the bath stirred for two days then ultrafiltered 50 percent with water added back then ultrafiltered another 50 percent. A portion of the permeate was passed through an ion exchange column with AMBERLITE IRC-84. The ion exchange resin removed the iron phenanthroline complex as is indicated by the <1 ppm soluble iron in the permeate after ion exchange (as determined by atomic absorption spectroscopy). The permeate and the permeate which had been passed through the ion exchange resin were submitted for X-ray fluorescence analysis in order to determine what metal ions had been removed by the ion exchange column. The results of this analysis follow:

| Element | Permeate | Ion Exchanged Permeate |
|---|---|---|
| Sodium | Present | None Detected |

-continued

| Element | Permeate | Ion Exchanged Permeate |
|---|---|---|
| Aluminum | Present | Present |
| Silicon | Present | Present |
| Potassium | Present | None Detected |
| Calcium | Present | None Detected |
| Iron | Present | None Detected |
| Barium | Present | None Detected |
| Lead | Present | None Detected |
| Zinc | Present | None Detected |
| Copper | Present | None Detected |
| Nickel | Present | None Detected |

What is claimed is:

1. In a method for electrocoating an electrically conductive surface serving as an electrode, which method comprises passing an electrical current between the electrically conductive surface to be electrocoated and a counter electrode in contact with an electrodeposition bath comprising a synthetic resin ionically dispersed in an aqueous medium and also containing metals, wherein the improvement comprises (a) adding a complexing agent, and then (b) removing at least a portion of the complexing agent along with metals coordinated therewith from the bath.

2. The method of claim 1 wherein the electrically conductive surface being electrocoated is the cathode and the counter electrode is the anode.

3. The method of claim 1 in which the complexing agent is a chelating agent.

4. The method of claim 1 wherein in step (a) the complexing agent coordinates with soluble iron in the bath.

5. The method of claim 4 wherein iron in the bath is reduced from a ferric state to a ferrous state before the chelating agent is added.

6. The method of claim 5 wherein the iron is reduced by adding to the bath a reducing agent selected from the group consisting of hydroquinone, erythorbic acid, sodium metabisulfite, sodium sulfite, sodium formaldehyde sulfoxylate, ascorbic acid, hydrogen sulfide, sulfurous acid, zinc, cadmium, aluminum and silver.

7. The method of claim 5 wherein the reducing agent is added in an amount of about 0.5 to about 1.5 equivalents of reducing agent per equivalent of soluble iron in the bath.

8. The method of claim 3 wherein the chelating agent is selected from the group consisting of 1,10-phenanthroline, 4,7-diphenyl-1,10-phenanthroline, alpha, alpha'-dipyridyl, 2,2',2''-terpyridyl, 2-pyridinealdoxime, ethylenediamine tetraacetic acid, diethylenetriamine pentaacetic acid, methyl acetoacetate and acetylacetone.

9. The method of claim 8 wherein the chelating agent is 1,10-phenanthroline.

10. The method of claim 9 wherein the 1,10-phenanthroline is mixed with ethylhexanoic acid.

11. The method of claim 8 wherein the chelating agent is alpha, alpha'-dipyridyl.

12. The method of claim 3 wherein the chelating agent is added in an amount of about 0.5 mole equivalent of chelating agent per equivalent of soluble iron in the bath to about 7 mole equivalents of chelating agent per equivalent of soluble iron in the bath.

13. The method of claim 1 wherein the removal of the complexing agent along with metals coordinated therewith is effected by passing at least a portion of the bath initially containing the complexing agent along with metals coordinated therewith through a membrane that retains the dispersed resin and passes water and solute of substantially smaller molecular size than said resin.

14. The method of claim 13 wherein the complexing agent and metals coordinated therewith are included in the solute passed by the membrane.

15. The method of claim 14 wherein the retained dispersed resin is returned to the bath and metals are removed from the water and solute passed by the membrane.

16. The method of claim 15 wherein the water and solute passed by the membrane is contacted with an ion exchange resin to remove metals.

17. The method of claim 15 wherein the water and solute contacted by the ion exchange resin is returned to the bath.

18. The method of claim 1 wherein the stability constant of the complexing agent is greater than the stability constant of the resin in the bath.

19. The method of claim 1 wherein the complexing agent is soluble in the resin.

20. The method of claim 12 wherein the chelating agent forms a complex with metals which are soluble in water.

21. The method of claim 8 wherein the bath contains soluble iron, at least some of which is complexed with the chelating agent.

22. The method of claim 13 wherein the bath contains soluble iron, at least some of which is complexed with the chelating agent.

23. The method of claim 18 wherein the bath contains soluble iron, at least some of which is complexed with the chelating agent.

24. The method of claim 19 wherein the bath contains soluble iron, at least some of which is complexed with the chelating agent.

25. The method of claim 1 wherein the bath contains at least one soluble metal selected from the group consisting of sodium, potassium, calcium, iron, barium, lead, zinc, copper and nickel.

* * * * *